US006089930A

United States Patent [19]

Matsuoka et al.

[11] Patent Number: 6,089,930

[45] **Date of Patent: *Jul. 18, 2000**

[54] TERMINAL ASSEMBLING STRUCTURE AND METHOD

[75] Inventors: Hiroyuki Matsuoka, Yokkaichi; Nobuhiro Takada; Kouichi Shirouzu, both of Toyota; Hiroshi Kobayashi, Okazaki; Shinobu Okayama, Aichi, all of Japan

[73] Assignees: Sumitomo Wiring Systems, Ltd., Mie; Toyota Jidosha Kabushiki Kaisha, Toyota, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/076,896

[22] Filed: May 13, 1998

[30] Foreign Application Priority Data

Jun. 3, 1997 [JP] Japan ..... 9-145019

[51] Int. Cl.[7] ..... H01R 9/24

[52] U.S. Cl. ..... 439/886; 439/883

[58] Field of Search ..... 439/883, 886, 439/287, 288, 874; 228/194; 411/171, 258

[56] References Cited

U.S. PATENT DOCUMENTS

| | | | |
|---|---|---|---|
| 2,655,641 | 10/1953 | Asaff | 439/886 |
| 2,724,097 | 11/1955 | Matthysse | 439/784 |
| 3,002,173 | 9/1961 | Allen | 439/883 |
| 3,157,735 | 11/1964 | Stroup et al. | 174/94 R |
| 3,372,476 | 3/1968 | Peiffer et al. | 439/886 |
| 5,334,809 | 8/1994 | DiFrancesco | 200/262 |
| 5,529,509 | 6/1996 | Hayes et al. | 439/288 |
| 5,558,531 | 9/1996 | Ikeda et al. | 439/287 |
| 5,577,927 | 11/1996 | Okada et al. | 439/287 |
| 5,586,899 | 12/1996 | Okada | 439/287 |
| 5,720,622 | 2/1998 | Ishikawa et al. | 439/86 |
| 5,934,923 | 8/1999 | Matsuoka et al. | 439/883 |

FOREIGN PATENT DOCUMENTS

| | | | |
|---|---|---|---|
| 0 670 612 A1 | 9/1995 | European Pat. Off. . | |
| 0 803 935 A2 | 10/1997 | European Pat. Off. . | |
| 4-6762 | 1/1992 | Japan | 439/805 |
| 7-32863 U | 6/1995 | Japan . | |

OTHER PUBLICATIONS

Boyer, L., "Connectique par polymére: The use of polymer coatings in connector technology," *L'Onde Electrique,* vol. 74, No. 4, Jul./Aug. 1994, pp. 29–33.

Antller, Morton, "Effect of Surface Contamination on Electric Contact Performance," *I.E.E.E. Circuits and Devices Magazine,* vol. 3, No. 2, (1987) Mar., pp. 8–20.

Tanaka, T., "Connectors for Low Level Electronic Circuitry," *Australian Electronics Engineering,* May 1982, pp. 46, 48.

Bender, Dale and Fister, Julius, "Performance Characteristics of a New Tin Coating for Electric and Electronic Interconnections," Proceedings of the Technical Program, Nepco West '95, Proceedings Nepco West 95, Anaheim, CA, Feb. 26–Mar. 2, 1995, pp. 1482–1491

Mroczkowski, Robert, "Electrical Contacts Get Off the Gold Standard," *Machine Design,* vol. 61, No. 7, Apr. 1989, pp. 134–137.

*Primary Examiner*—Neil Abrams
*Attorney, Agent, or Firm*—Oliff & Berridge, PLC

[57] ABSTRACT

A terminal assembling structure includes a terminal metal fitting having a tinning layer on a surface thereof, a connecting portion overlapped with the terminal metal fitting, and a fastening member fastening the terminal metal fitting and the connecting portion. An adhesion phenomenon of metal is generated between the terminal metal fitting and the connecting portion by the fastening of the terminal member.

6 Claims, 6 Drawing Sheets

TERMINAL ASSEMBLING STRUCTURE AND METHOD

BACKGROUND OF THE INVENTION

1. Field of the Invention

The invention relates to a terminal assembling structure which fastens a terminal metal fitting to a connecting portion by use of a bolt, or the like, and a terminal assembling method thereof.

2. Description of the Related Art

When a plurality of ground terminals individually connected to a plurality of devices are to be mounted onto a vehicle body, for convenience there is a structure in which the ground terminals are assembled together into an integral assembly such that they are overlapped with each other. The assembly is then fixedly fastened to the vehicle body by use of a bolt. In such structure, by tightening the bolt, not only can the ground terminals be in close contact with the vehicle body, but each ground terminal can be closely contacted with each other ground terminal. Due to such close contact between the ground terminals, even the ground terminals that are not in direct contact with the vehicle body can be in indirect conduction with the vehicle body.

However, in the above-mentioned conventional structure, electric conduction between the ground terminals, that is, between the ground terminal and the mating connecting portion, is maintained by the fastening force of the bolt. Therefore, if the bolt loosens, contact resistance between both terminals increases rapidly, which can be problematic.

SUMMARY OF THE INVENTION

The invention aims at eliminating the above-mentioned drawbacks found in the conventional terminal assembling structure and terminal assembling method. Accordingly, the invention relates to a structure in which a terminal metal fitting is overlappingly fastened. It is an object of the invention to provide a terminal assembling structure and method which can prevent a contact resistance between a terminal metal fitting and the other connecting portion from rapidly increasing in spite of a decline in the fastening force.

The terminal assembling structure includes a terminal metal fitting having a tinning layer on a surface thereof, a connecting portion overlapped with the terminal metal fitting, and a fastening member fastening the terminal metal fitting and the connecting portion so as to hold a contact state between the terminal metal fitting and the connecting portion. An adhesion phenomenon of metal is generated between the terminal metal fitting and the connecting portion by the fastening of the terminal member.

In addition, in a terminal assembling method, a terminal metal fitting having a tinning layer on a surface thereof is overlapped with a connecting portion and is fastened to the connecting portion by a fastening member, whereby the terminal metal fitting and the connecting portion are held in a contact state. A contact region between the terminal metal fitting and the connecting portion is fastened so that pressure greater than 6 $N/mm^2$ is applied, thereby causing an adhesion of the tinning layer in the contact region.

BRIEF DESCRIPTION OF THE DRAWINGS

Similar reference characters denote corresponding features consistently throughout the attached drawings. The preferred embodiments of this invention will be described in detail, with reference to the following figures, wherein.

DETAILED DESCRIPTION OF THE INVENTION

Preferred embodiments of the invention will be described in detail hereinafter with reference to the accompanying drawings. The invention is based on a discovery concerning a terminal metal fitting having a tinning layer that is overlapped with a connecting portion, when strong pressure is applied between the terminal metal fitting and the connecting portion, an adhesion phenomenon of metal is generated in the tinning layer, thereby greatly decreasing the contact resistance. Further, once the adhesion phenomenon is generated, even if the fastening pressure is loosened, the contact resistance remains in a low state.

In the invention, the terminal metal fitting is assembled by overlapping the terminal metal fitting with a connecting portion. When the terminal metal fitting is fastened by a fastening tool, strong pressure is applied between the terminal metal fitting and the connecting portion so that the adhesion phenomenon of metal is generated by the tinning layer provided on the surface of the terminal metal fitting at a part of the connecting portion. Although the surface of the terminal metal fitting is usually covered with a thin film of a metallic oxide or other compound, when strong pressure is partially applied, the film is broken, whereby the adhesion phenomenon of metal is generated.

When the film is an oxide film and the overlapped terminal metal fittings are fastened, the contact resistance between the terminal metal fittings is decreased as the fastening force is increased. However, when the fastening force of the terminal metal fitting is weakened, the contact resistance between the terminal metal fittings is increased in accordance with the looseness. The change between the contact load and the contact resistance when conventional terminal metal fittings are fastened is qualitatively shown in FIG. 1B in accordance with the results of experimentation. Conventionally, the contact resistance between the terminal metal fittings is rapidly increased when a bolt for fastening the terminal metal fittings is loosened.

Figure 1A:
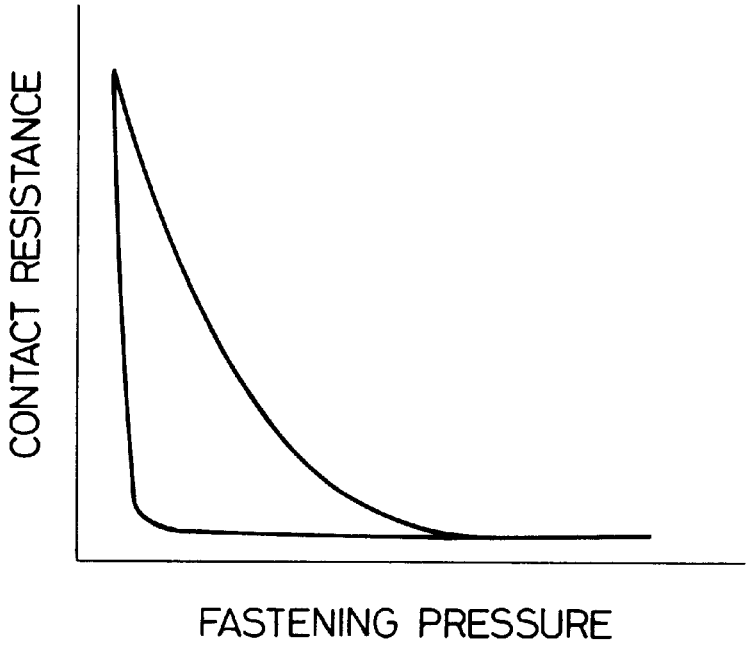
FIGS. 1A and 1B are diagrams showing the relationship between the fastening pressure and the contact resistance which qualitatively represents a principle of the invention.
Figure 1B:
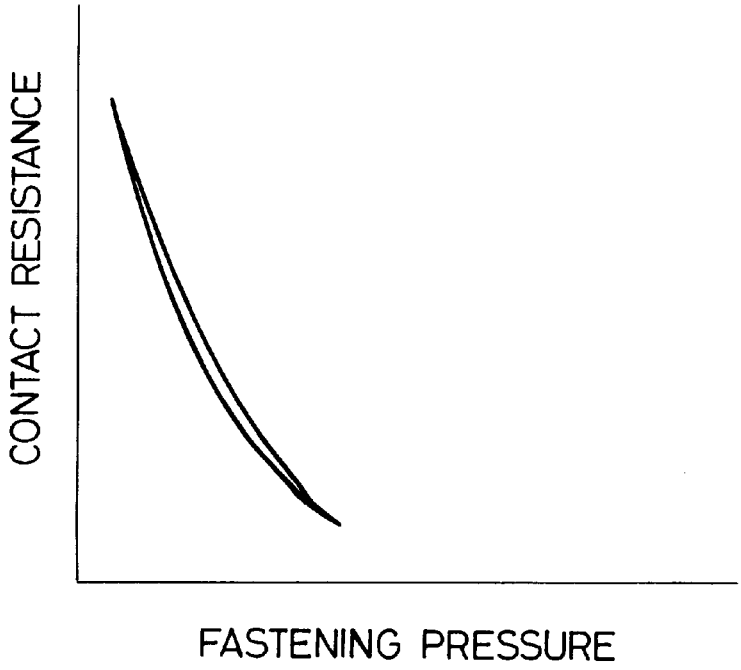
Figure 2:
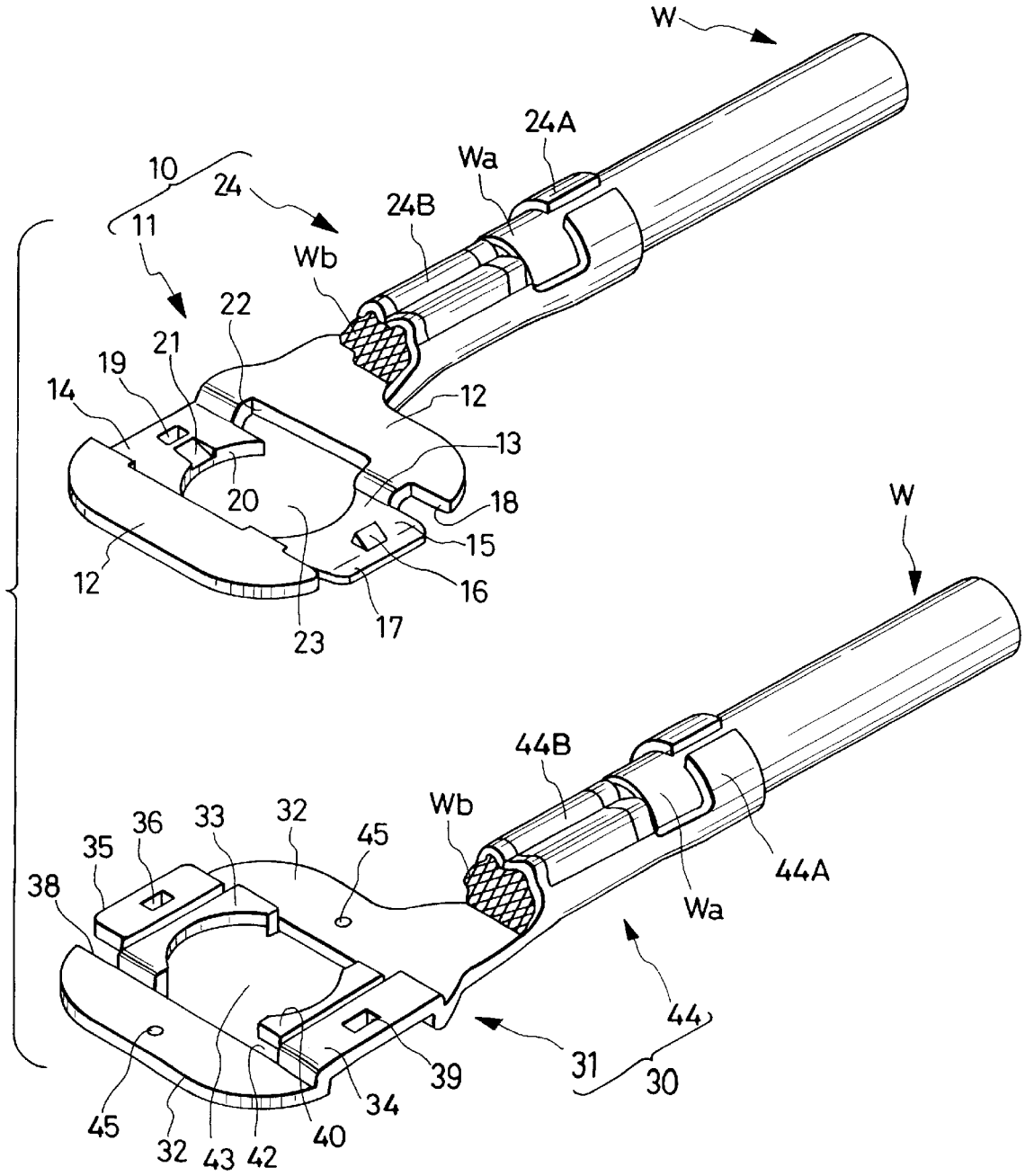
FIG. 2 is a perspective view of an embodiment according to the invention showing two terminal metal fittings separated from each other.
Figure 3:
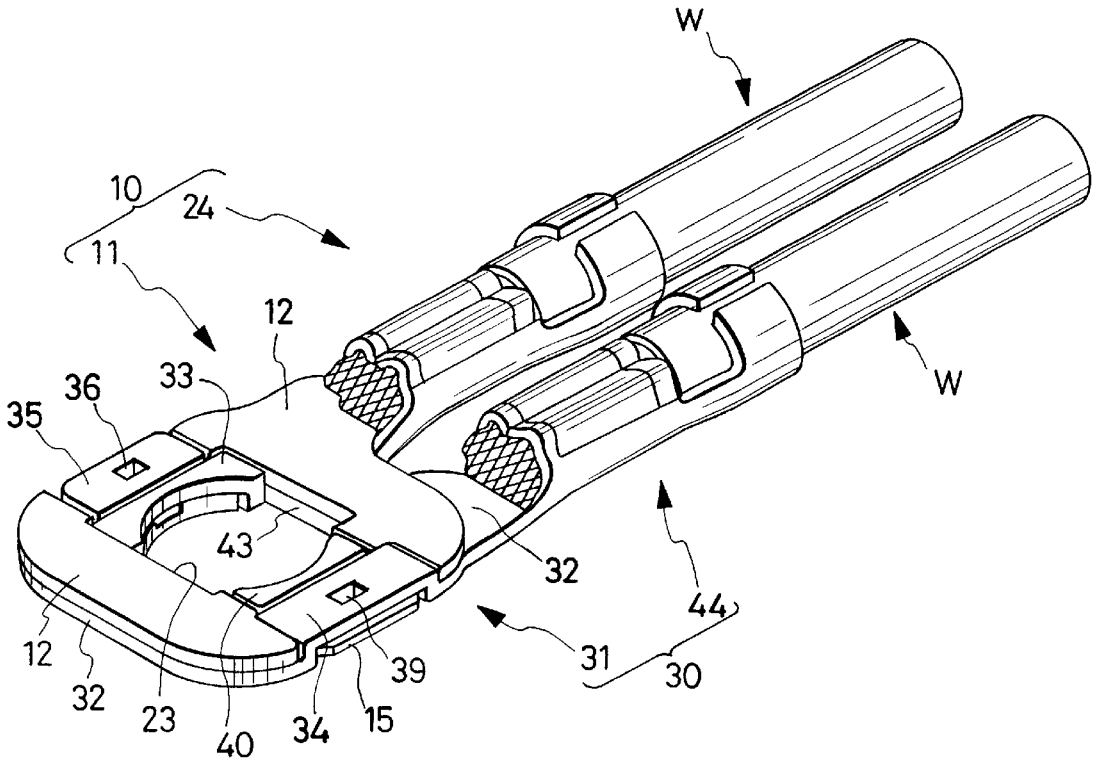
FIG. 3 is a perspective view of an embodiment according to the invention showing the two terminal metal fittings assembled together.

By contrast, in accordance with the invention, when the terminal metal fitting is fastened so that the adhesion phenomenon of the tinning layer between the terminal metal fitting and the mating connecting portion is generated, even if the fastening tool is loosened, the conduction is maintained in the metal adhesion portion. That is, the contact resistance changes as shown in FIG. 1A, and as long as the fastening force is slightly maintained, the contact resistance is maintained in the extremely low state.

According to experimentation, regardless of slight differences in the state of the surface of the terminal metal fitting, composition of the tinning layer, or the like, the adhesion phenomenon of metal was easily generated in the contact portion by fastening the terminal metal fitting with approximately more than 6 $N/mm^2$ of pressure applied between the terminal metal fitting having the tinning layer and the contact portion of the connecting portion.

In accordance with an embodiment of the invention, two terminal metal fittings are assembled together into a ground terminal metal fitting assembling structure and the resultant assembly is mounted onto the body of a vehicle. Accordingly, one ground terminal metal fitting corresponds to the previously described terminal metal fitting, and the other ground terminal metal fitting corresponds to the previously described connecting portion.

To form the first terminal metal fitting 10, a conductive metal plate is punched out into a given shape. The punched metal plate is then bent, and a surface of the metal plate forms a tinning layer which plates the surface thereof by tin. Further, a surface of the tinning layer is usually covered with a thin film of metallic oxide or other compound. The first terminal metal fitting 10 includes an assembling portion 11 and an electric wire connecting portion 24. The assembling portion 11 includes plate-like overlap portions 12 composed of two flat plates arranged in parallel to and spaced apart from each other, a plate-like securing portion 13 disposed between respective one-side end portions of the two plate-like overlap portions 12 in such a manner that the securing portion 13 spans the two overlap portions 12, and a plate-like receiving portion 14 disposed between the respective end portions of the two plate-like overlap portions 12 opposite to the above-mentioned end portions thereof for the securing portion 13 in such a manner that the receiving portion 14 spans the two overlap portions 12. The two plate-like overlap portions 12 are set flush with each other. Also, the securing portion 13 and receiving portion 14 are set flush with each other and are also set at a height which differs from, i.e., is lower than, the two plate-like overlap portions 12 by an amount substantially equal to the plate thickness of the plate-like overlap portions 12.

In the securing portion 13, there is formed a displacement restriction portion 15 which is set flush with the securing portion 13 and extends out in the opposite direction of the receiving portion 14. And, on the upper surface of the displacement restriction portion 15, a securing claw 16 is formed by cutting and raising the same upper surface. The securing claw 16 can be engaged with a securing hole 39 formed in a second terminal metal fitting 30 to be described later. In the leading end edge of the displacement restriction portion 15 there is formed an inclined guide surface 17 which is used to facilitate an engaging operation between the securing portion 13 and a receiving portion 34 formed in a second terminal metal fitting 30. Between the displacement restriction portion 15 and the two overlap portions 12 there are formed escape grooves 18 into which connecting portions between the two plate-like overlap portions 32 of the second terminal metal fitting 30 and a receiving portion 34 formed in the second terminal metal fitting 30 can be inserted.

In the upper surface of the receiving portion 14, there is formed a securing hole 19 which can be engaged with a securing claw 36 provided in the second terminal metal fitting 30. The receiving portion 14 further includes a projecting portion 20 which is set flush with the receiving portion 14 and extends toward the displacement restriction portion 15. In the upper surface of the projecting portion 20, there is formed an inclined guide surface 21 which is used to facilitate the fitting operation of the securing hole 19 with the securing claw 36 of the second terminal metal fitting 30. Also, between the projecting portion 20 and the two plate-like overlap portions 12, there are formed escape grooves 22 into which connecting portions located between a securing portion 33 and two plate-like overlap portions 32 respectively formed in the second terminal metal fitting 30 can be inserted.

The mutually opposed edges of the securing portion 13 and projecting portion 20 are respectively formed as arc-shaped edges which are concentric with each other and equal in diameter to each other. The two plate-like overlap portions 12 of the first terminal metal fitting 10 are arranged in such a manner that the side edges thereof can be in contact with virtual circles which are respectively concentric and equal in diameter with the above described arcs. Further, a space enclosed by the edges provides an insertion hole 23 into which a stud bolt (not shown) can be fitted.

An electric wire connecting portion 24 is formed integrally with the assembling portion 11. That is, the electric wire connecting portion 24 is arranged in such a manner that it extends from the end portion side edge of one of the plate-like overlap portions 12 on the receiving portion 14 side thereof toward a direction at a right angle to the longitudinal direction of the plate-like overlap portion 12. The electric wire connecting portion 24 includes an insulation barrel 24A and a wire barrel 24B. The insulation barrel 24A is crimped from the side of the associated equipments (not shown) on a resin cover Wa provided in the terminal portion of a ground wire W, whereas the wire barrel 24B is crimped on a core wire Wb which is exposed by peeling off the resin cover Wa of the ground wire W.

To produce the second terminal metal fitting 30, a conductive metal plate is punched out into a given shape and the thus punched metal plate is then bent, so that it includes an assembling portion 31 and an electric wire connecting portion 44. The assembling portion 31 has a structure in which the assembling portion 11 of the first terminal metal fitting 10 is turned upside down. That is, the plate-like overlap portions 32 of the assembling portion 31 can be overlapped with the lower surface sides of the plate-like overlap portions 12 of the first terminal metal fitting 10, respectively, and a securing portion 33 and receiving portion 34 of the assembling portion 31 can be overlapped with the upper surface sides of the receiving portion 14 and securing portion 13 of the first terminal metal fitting 10, respectively. In the assembling portion 31 of the second terminal metal fitting 30 as well, there is formed a displacement restriction portion 35 and a securing claw 36 in the securing portion 33. A securing hole 39 and a projecting portion 40 are formed in the receiving portion 34. Further, there is formed an insertion hole 43 which is identical to the insertion hole 23 of the first terminal metal fitting 10. Escape grooves 38 and 42 are formed respectively between the displacement restriction portion 35 and two plate-like overlap portions 32 as well as between the projecting portion 40 and the two plate-like overlap portions 32.

Similar to the electric connecting portion 24 of the first terminal metal fitting 10, the electric wire connecting portion 44 includes an insulation barrel 44A and a wire barrel 44B which are crimped on a ground wire W. The electric wire connecting portion 44 is arranged in such a manner that it extends from the end portion side edge of one of the plate-like overlap portions 32 on the receiving portion 34 side thereof in a direction at a right angle to the longitudinal direction of the plate-like overlap portion 32. Therefore, when the second terminal metal fitting 30 is assembled with the first terminal metal fitting 10, the electric wire connecting portion 44 can be arranged in parallel to the electric wire connecting portion 24 of the first terminal metal fitting 10.

A surface of a first terminal metal fitting side of the plate-like overlap portion 32, is provided with a circular protrusion 45 which is formed by punching from the back side of the first terminal metal fitting side. The height of the protrusion 45 is set in such a manner that a top portion of the protrusion 45 is higher than the height of the lower surface of the plate-like overlap portion 12 of the first terminal metal fitting 10, when the securing portions 13, 33 and the receiving portions 14, 34 are in contact with each other.

A procedure for assembling the above-mentioned first and second terminal metal fittings 10, 30 will now be described. At first, the first terminal metal fitting 10 is assembled with the second terminal metal fitting 30. To assemble the first terminal metal fitting 10 with the second terminal metal fitting 30, the first terminal metal fitting 10 is disposed above the second terminal metal fitting 30 and the securing portions 13, 33 thereof are respectively inserted into their mating insertion holes 43,23. From this condition, the securing portions 13, 33 are further slid in the longitudinal direction of the plate-like overlap portions 12, 32 (which is hereinafter referred to as an assembling direction) so that the insertion holes 23, 43 can be matched to each other. As a result, the displacement restriction portion 15 of the first terminal metal fitting 10 is positioned under the receiving portion 34 of the second terminal metal fitting 30 and, at the same time, the displacement restriction portion 35 of the second terminal metal fitting 30 is positioned on the receiving portion 14 of the first terminal metal fitting 10. Subsequently, the securing claws 16, 36 are fitted with the securing holes 19, 39, respectively, completing the assembly operation of the two terminal metal fittings 10, 30. In the assembled condition, the engagement between the securing claws 16, 36 and securing holes 19, 39 prevents the two terminal metal fittings 10, 30 against removal in the opposite direction to the assembling direction. The contact between the respective depth portions of the escape grooves 18, 42 and 22, 38 also prevents the two terminal fitting members from being assembled together in an excessive manner beyond the normal assembling position thereof. In addition, the engagement of the plate-like overlap portions 12, 32 and the engagement of the securing portions 13, 33 and receiving portions 14, 34 prevent the two terminal metal fittings 10, 30 against removal in a vertical direction.

In the assembled condition, both terminal metal fittings 10, 30 are slightly elastically deformed, so that the lower surface of the plate-like overlap portion 12 of the first terminal metal fitting 10 is in contact with the protrusion 45. Accordingly, by the elastic reversing force of the terminal metal fittings 10, 30, the protrusion 45 and the plate-like overlap portion 12 of the first terminal metal fitting 10 are strongly pressed to each other. Further, the securing portions 13, 33 and receiving portions 14, 34 are in strong contact, so that both terminal metal fittings 10, 30 are integrally connected.

Figure 4:
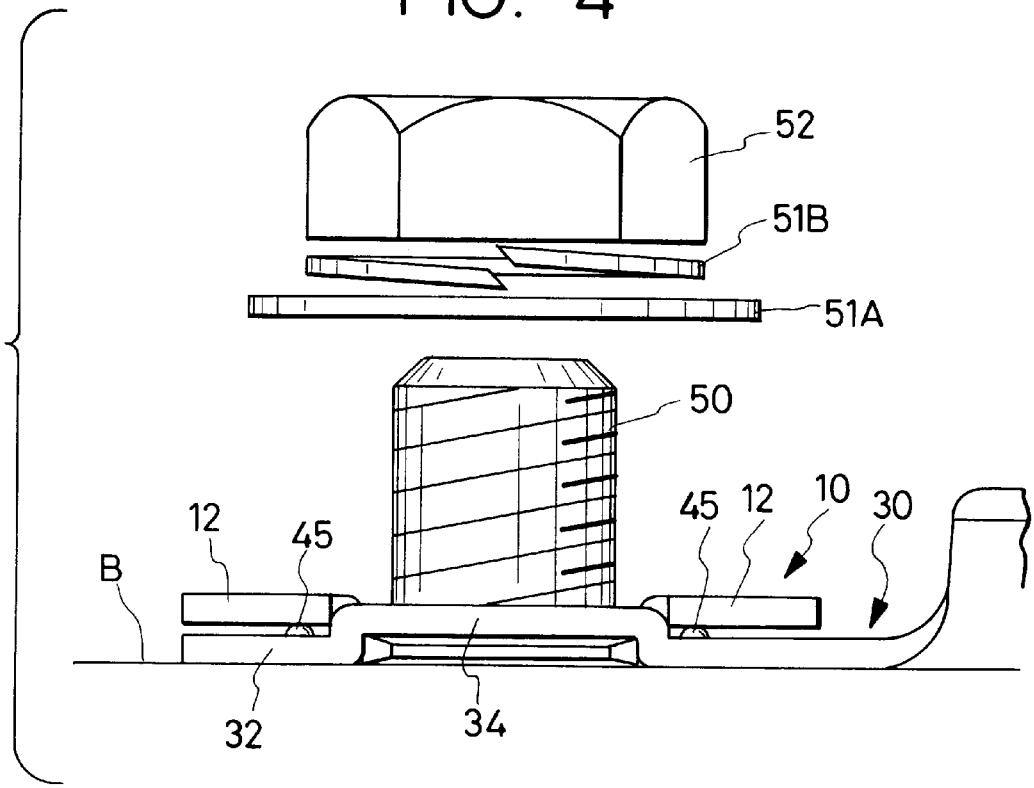
FIG. 4 is a side view of an embodiment according to the invention showing the two terminal metal fittings separated from each other.
Figure 5:
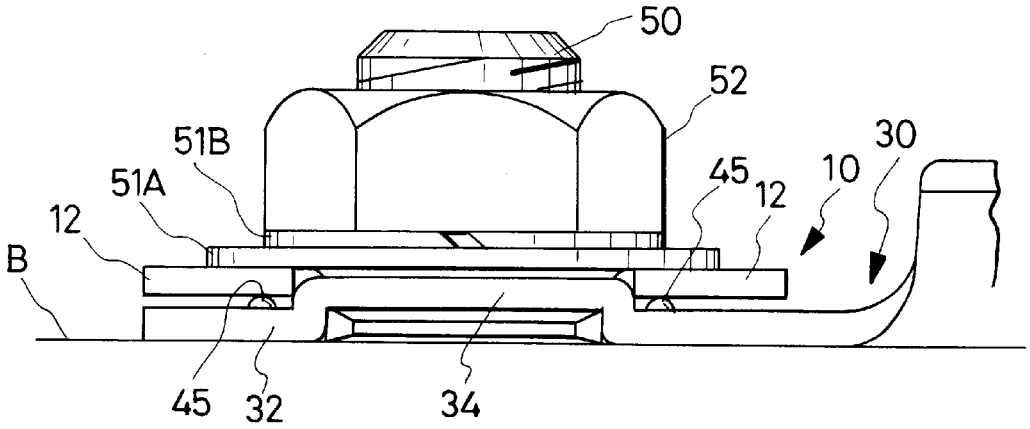
FIG. 5 is a side view of an embodiment according to the invention showing the two terminal metal fittings fastened together.

After assembly, the insertion holes 23, 43 of the terminal metal fittings 10, 30 can be inserted around the stud bolt 50 provided in the vehicle body B shown in FIG. 4. The stud bolt 50 is then fastened by screwing a nut 52, corresponding to a fastening tool, through a flat washer 51A and spring washer 51B. Thus, as shown in FIG. 5, the terminal metal fittings 10, 30 are fastened to each other in an overlapping state and are press-fitted to body B.

Figure 6:
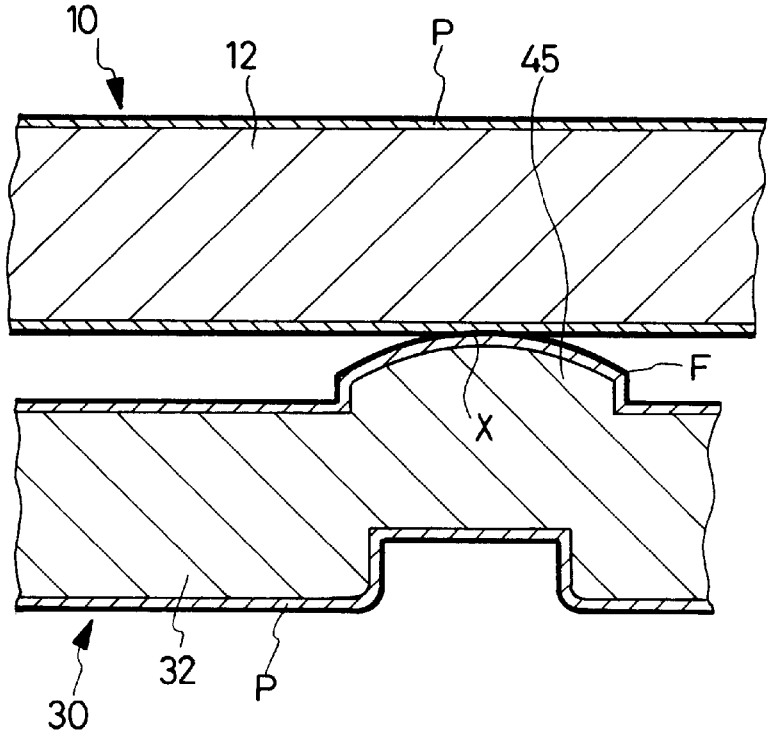
FIG. 6 is an enlarged sectional view of an embodiment according to the invention showing a contacting portion of the terminal metal fittings wherein the terminal metal fittings are fastened together.

A maximum torque can be set in such a manner that a fastening load of the nut 52 is more than 6 N (newton). Thus, strong pressure is applied to the contact portion of the protrusion 45 of the second terminal metal fitting 30 and the first terminal metal fitting 10. (In this embodiment, strong pressure corresponds to a pressure of more than 6 $N/mm^2$). As a result, in the contact portion, a thin film F of metallic oxide or other compound which covers the surface of each of the terminal metal fittings 10, 30 is broken. An adhesion phenomenon of the tinning layer P is generated, as shown in FIG. 6, whereby both terminal metal fittings 10, 30 are fixed to each other by an adhesion portion X.

Figure 7:
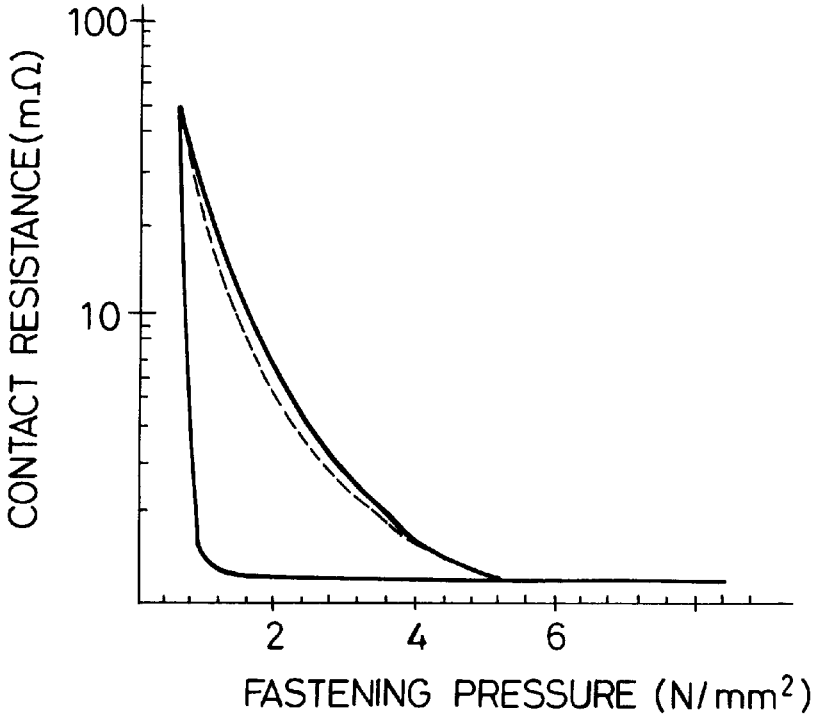
FIG. 7 is a diagram of an embodiment according to the invention showing the relationship between the fastening pressure and the contact resistance.

As described above, once the adhesion phenomenon of the metal is generated, the terminal metal fittings 10, 30 are fixed to the adhesion portion X. Therefore, even if the fastening force applied to the terminal metal fittings 10, 30 declines by loosening of the nut 52, the contact resistance between the terminal metal fittings 10, 30 is maintained in a low state. The measured value of contact resistance versus fastening pressure between the terminal metal fittings 10, 30 is shown as a solid line in FIG. 7. When the fastening pressure is set to be more than 6 $N/mm^2$, the change of the contact resistance with respect to the fastening pressure is represented as a hysteresis curve. Even if the fastening pressure due to loosening of the nut 52 declines to approximately 1 $N/mm^2$, the contact resistance is maintained at the same value as before the nut 52 is loosed. In particular, the contact resistance is maintained in a low value which is approximately 1 mΩ. If the fastening pressure does not reach 6 $N/mm^2$, as shown in the broken line of FIG. 7, the contact resistance increases in accordance with loosening of the nut 52. In such a case, if the fastening pressure declines to 1 $N/mm^2$, the contact resistance is increased greatly.

The adhesion phenomenon of metal is generated in the tinning layer by strongly fastening the terminal metal fittings 10, 30. Therefore, even if the fastening force of the nut 52 is loosened, the contact resistance between the terminals can be maintained at the low value, thereby increasing contact reliability between the terminals. Further, because protrusion 45 is formed, even if the fastening force is relatively weak, an extra strong fastening pressure is obtained at the end of the protrusion 45. Therefore the adhesion phenomenon is generated that reduces the contact resistance.

The invention is not limited to the embodiments discussed in the foregoing description with reference to the accompanying drawings but, for example, may include the following embodiments which also fall within the technical scope of the invention. Further, various other embodiments and modifications are also possible without departing from the scope of the subject matter of the invention.

Figure 8:
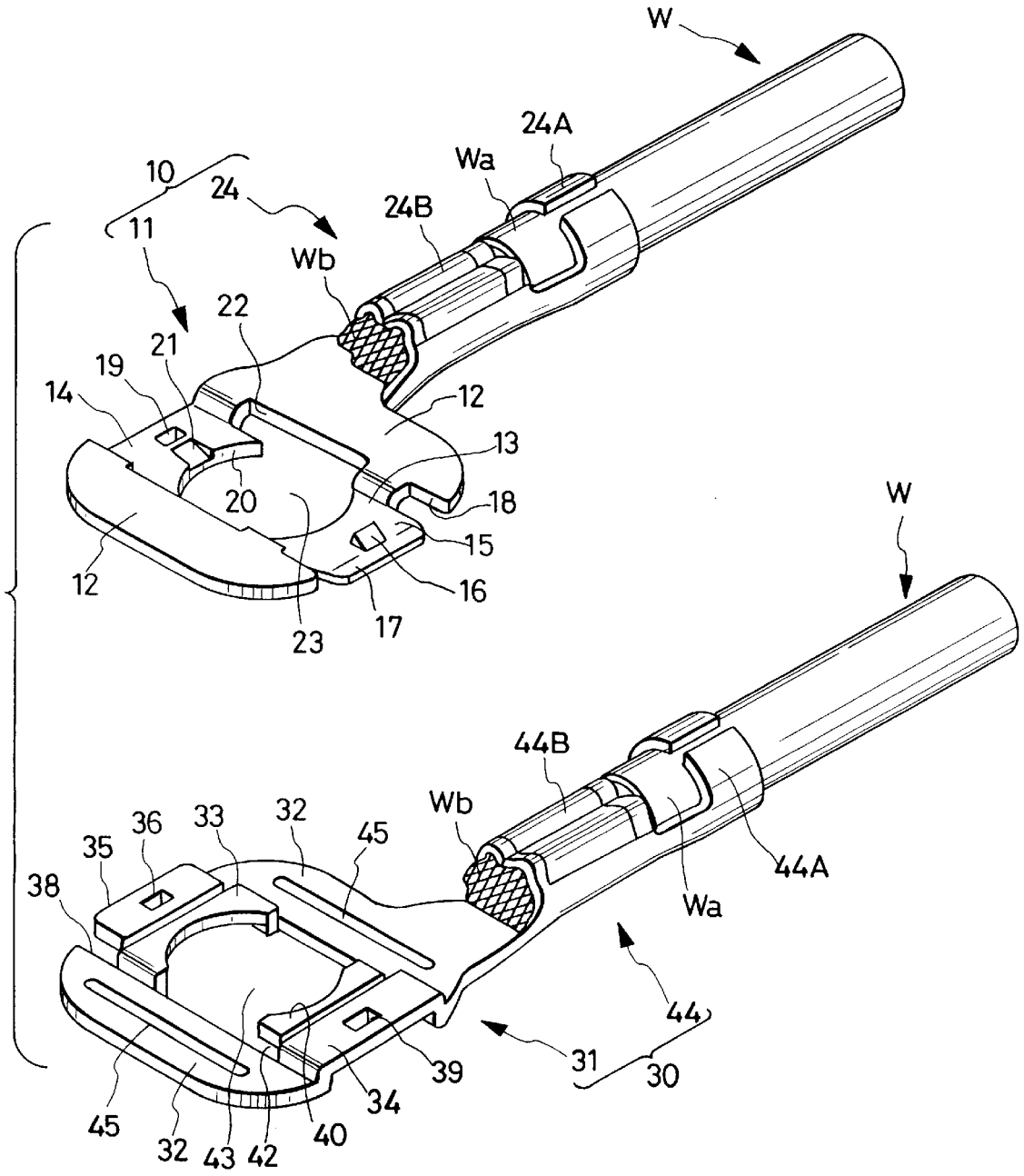
FIG. 8 is a perspective view of an embodiment according to the invention showing two terminal metal fittings separated from each other.

In the illustrated embodiment, although the projecting portion 45 is formed in a circular shape, this is not limitative. The invention can also be structured so that the projecting portion 45 projects in a linear shape (FIG. 8). Further, the projecting portion may be provided in only one position, or more than three positions. In addition, the height or size of the projecting portion may be suitably selected in accordance with the size, the material or the like of the terminal metal fitting. Moreover, the projecting portion may not be essential to the invention, that is, the terminal metal fitting may be fastened so that the adhesion phenomenon of metal is generated between the terminal metal fitting having the tinning layer and the connecting portion.

In the illustrated embodiment, the projecting portion 45 is provided only in the second terminal metal fitting 30. However, the projecting portion 45 can also be provided only in the first terminal metal fitting 10, or can be formed in both the first and second terminal metal fittings 10, 30.

In the illustrated embodiment, a description has been given of a case in which the invention is applied to a terminal metal fitting assembly structure of a type in which the two terminal metal fittings 10, 30 are assembled together by sliding them along the plate surfaces of the plate-like overlap portions thereof. However, the invention can also be applied to an assembly structure in which insertion holes are matched to each other and two terminal metal fittings are then rotated about the insertion holes with respect to each other so that the two terminal metal fitting can be assembled together.

In the illustrated embodiment, a description has been given of a case in which the two terminal metal fittings 10, 30 are assembled together. However, the invention can also be applied to a case in which three or more terminal metal fittings are assembled together. In addition, the invention is not limited in a case that the terminal metal fittings are overlapped to each other, rather, the invention can be applied to a structure in which the terminal metal fitting is fastened so as overlap in the other connecting portion. Further, the invention can also be applied to terminal metal fittings for use in applications other than grounding.

What is claimed is:

1. A terminal assembling structure, comprising:

a terminal metal fitting having a tinning layer on a surface thereof and at least one protrusion extending from the surface thereof;

a connecting portion having a tinning layer on a surface thereof and configured to connect with said terminal metal fitting; and a fastening member fastening said terminal metal fitting and said connecting portion with a fastening load of more than 6N/mm$^2$ to form a mechanical connection where the protrusion contacts the connecting portion, so as to hold the tinning layer of said terminal metal fitting and the tinning layer of said connecting portion in a state of electrical contact, and to generate an adhesion phenomenon of metal between said protrusion of said terminal metal fitting and said connecting portion at the application of the fastening load by said fastening member to create an electrical contact that is maintained when the fastening load applied by the fastening member diminishes.

2. A terminal assembling method, comprising the steps of:

providing a terminal metal fitting having a tinning layer on a surface thereof and at least one protrusion extending from the surface and configured to connect with a connecting portion having a tinning layer on a surface thereof;

applying a fastening load that fastens the terminal metal fitting to the connecting portion by a fastening member, whereby the tinning layer of said terminal metal fitting and the tinning layer of said connecting portion are held in a state of contact at a contact region; and generating an adhesion of metal in the contact region between said protrusion of the terminal metal fitting and said connecting portion by fastening the terminal metal fitting and the connecting portion with a pressure more than 6 N/mm$^2$ such that the adhesion in the contact region is maintained when the fastening load diminishes.

3. A terminal assembly structure, comprising:

at least two metal terminals, each metal terminal comprising:

an assembly portion; and a wire connecting portion for attaching the metal terminal to a wire for conducting electric current;

wherein one of the metal terminals includes at least one protrusion extending from the assembly portion;

a mounting element that receives the at least two metal terminals; and a pressure applying element that retains the at least two metal terminals on the mounting element under pressure of more than 6N/mm$^2$ through mechanical interlock and adhesion between the terminals where the protrusion of one terminal contacts the other terminal, wherein a surface layer of an electrically conductive bonding material including tin is applied to the at least two metal terminals and wherein the bonding material exhibits adhesion properties under pressure where the terminals contact and maintains electrical contact when the pressure diminishes.

4. The terminal assembly structure according to claim 3, wherein a shape of the assembly portion of a first metal terminal is complementary to the shape of the assembly portion of a second metal terminal, when assembled the first metal terminal and the second metal terminal.

5. The terminal assembly structure according to claim 4, wherein each metal terminal further comprises means for interlocking the assembled metal terminals.

6. The terminal assembly structure according to claim 3, wherein the mounting element is a bolt, the pressure applying element is a nut threadably joined to the bolt, and the bolt and the nut form a mounting assembly.

* * * * *